US005769558A

United States Patent [19]

Jekielek

[11] Patent Number: 5,769,558

[45] Date of Patent: Jun. 23, 1998

[54] FLEX JOINT

[75] Inventor: David W. Jekielek, Houston, Tex.

[73] Assignee: Radius Metier, Inc., Houston, Tex.

[21] Appl. No.: 730,821

[22] Filed: Oct. 17, 1996

[51] Int. Cl.[6] ..... F16D 3/00; E21B 7/08

[52] U.S. Cl. ..... 403/229; 403/220; 175/73

[58] Field of Search ..... 403/229, 220, 403/291, 24; 175/256, 73; 166/385

[56] References Cited

U.S. PATENT DOCUMENTS

| | | | |
|---|---|---|---|
| 2,474,690 | 6/1949 | Robinson et al. | 403/229 |
| 2,477,827 | 8/1949 | Robinson | 403/229 |
| 2,546,026 | 3/1951 | Coon | 403/229 X |
| 2,558,763 | 7/1951 | Lee | 403/229 X |
| 3,879,024 | 4/1975 | Scott et al. | 403/220 X |
| 5,050,682 | 9/1991 | Huber et al. | 166/385 X |
| 5,297,641 | 3/1994 | Falgout, Sr. | 175/73 |
| 5,314,032 | 5/1994 | Pringle et al. | 175/256 X |
| 5,450,914 | 9/1995 | Coram | 175/73 |

FOREIGN PATENT DOCUMENTS

| | | | |
|---|---|---|---|
| 937209 | 3/1948 | France | 403/229 |
| 47-48209 | 11/1972 | Japan | 403/229 |

*Primary Examiner*—Harry C. Kim
*Attorney, Agent, or Firm*—Vaden, Eickenroht & Thompson, L.L.P.

[57] ABSTRACT

A flex joint is disclosed for connecting two cylindrical instrument housings of a downhole instrument assembly that will bend as required to allow the instrument housings to move through a curved section of a well bore. The joint includes spaced tubular connectors for connecting the joint to the cylindrical housings. The connectors are connected by a flexible cable or thin walled cylindrical tube. One or more helical springs extend between the connectors and are held in compression to urge the connectors toward an in-line position while allowing the joint to bend as required for the cylindrical instrument housings to travel through a curved section of a well bore.

5 Claims, 3 Drawing Sheets

FIG.3A
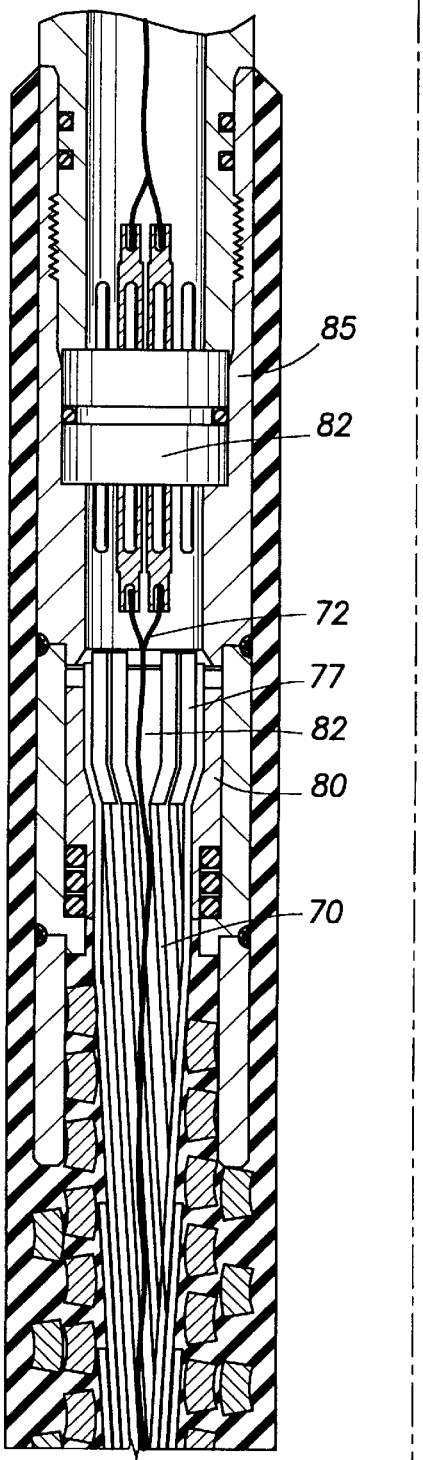
FIG.3B
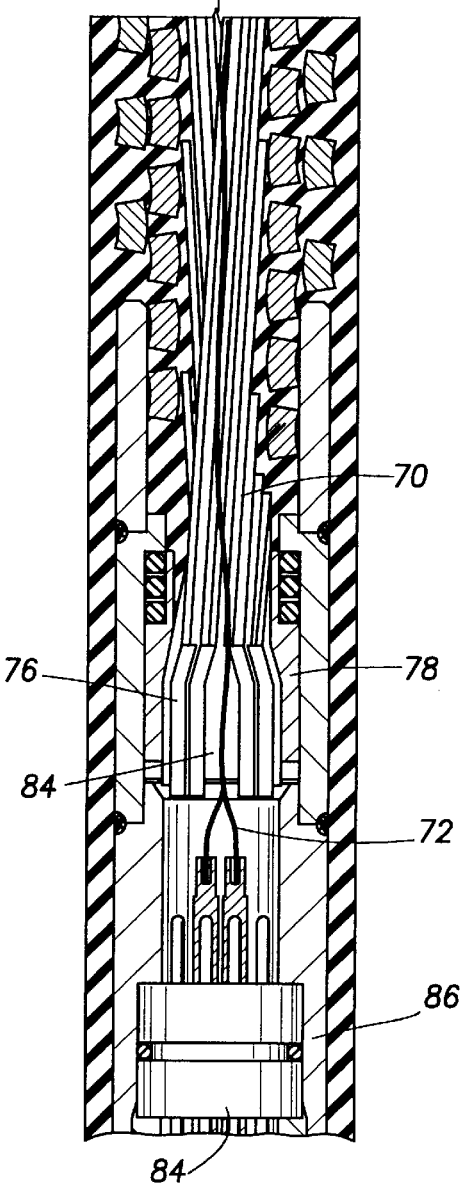
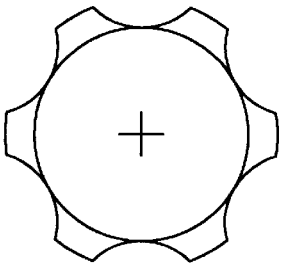
FIG.4

FLEX JOINT

This invention relates to flex joints generally and in particular to flex joints for connecting components of a downhole drilling assembly used in horizontal drilling.

In tight formations such as the Austin Chalk and Sprayberry, oil and gas is accumulated in cavities formed by fractures in the formations. So the practice is to drill a vertical hole to the top of the producing formation, kick the well off vertical and build angle until the bit is drilling horizontally or, if the formation is inclined, along the centerline of the formation. This lateral hole is drilled until one or more fractures are encountered that contains oil or gas or to the practical limits of the equipment. These horizontal holes may extend 2,500 ft. or more from the vertical hole.

The first step in drilling a horizontal hole is to mill a window in the casing, set a cement plug, and sidetrack off the cement plug. Then the kickoff drilling assembly is replaced by an angle-building drilling assembly that drills the curved section to the desired angle, usually horizontal, in the formation to be explored. The angle-building assembly is then replaced by a drilling assembly for drilling the lateral hole that will hold the desired inclination of the hole. Both assemblies include a positive displacement hydraulically powered drilling motor and a steering tool to survey the curved and horizontal portions of the hole as they are drilled. The difference is that the build assembly has both a bent sub and a bent housing whereas the hold assembly uses only a bent housing.

The steering tool is electrically connected to the surface by a wireline and provides a continuous reading of the inclination and azimuth of the hole being drilled. If the hole is large enough measurement while drilling (MWD) tools are sometimes used instead of the hard-wired steering tools. The drilling assembly will include a Monel drill collar in which the steering tool is located.

Both the angle building assembly and the lateral hole drilling assembly must travel through the curved section that leads from the vertical hole to the lateral hole. Originally the curved sections had a radius of about 350 ft. but today the radius of the curved section has been reduced to about 100 ft. In other words, a 90° turn from the vertical to the horizontal will occur with a radius of about 100 ft. The components, however, that make up the downhole drilling assemblies are located in housings that when connected together will not readily bend around such a short radius.

Therefore, there is a need for a flexible joint for connecting the various components of the downhole assembly to allow the downhole assembly to easily pass through a hole having a radius of curvature of 100 ft.

Thometz et al. U.S. Pat. No. 4,901,804 describes a flex joint that is presently in use. Thometz et al.'s flexible joint connects two instrument housings and consists of a "flexible connector means having an intermediate portion which is substantially smaller in transverse cross section than said housings." The "intermediate portion" is either a thin-walled tubing when an electrical connection between the housings is required or a solid small diameter rod when an electrical connection is not required. The intermediate portion does the bending and obviously, the amount of bending that such a flex joint can do without permanent deformation is limited. Further, the flexibility of such a flex joint is directly related to the length and diameter of the rod or tube.

Therefore, it is an object and feature of this invention to provide a flexible connection or flex joint for connecting elongated, relatively rigid sections of a downhole assembly that will readily bend to allow the rigid housings to traverse a curved section of well bore having a radius as small as 100 ft.

It is a further object and feature of this invention to provide such a flex joint comprising rigid tubular connectors for connecting to instrument housings and a flexible intermediate section between the connectors, the flexibility of which is independent of the diameter of the intermediate section.

It is a further object and feature of this invention to provide such a flex joint that includes two spaced connectors for connecting the flex spint in the downhole assembly, a flexible cable for connecting the connectors, and a helical spring positioned between the connectors to urge the connectors toward axial alignment while bending as required to allow the instrument housings connected by the joint to traverse a curved section of a borehole.

It is a further feature and object of this invention to provide such a flex joint that includes an electrical cable that extends through the connectors and through the spring or springs, where more than one spring is used, to allow electrical communication between the instrument housing sections of the downhole assembly connected at each end of the flex joint.

These and other objects and features of this invention will be apparent to those skilled in the art from a consideration of this specification including the attached drawings and appended claims.

IN THE DRAWINGS:

FIG.1 is a sectional view of one embodiment of the flex joint of this invention in which the ulpper and lower rigid connectors are connected by a flexible cable extending between and connected to the connectors and three helical springs that provide a resilient force urging the connectors and cable into axial alignment while bending as required to allow the instrument housings connected by the joint to pass through a curved section of the well bore.

FIG. 3 is a sectional view of the flex joint of FIG. 2 modified to provide a multi-conductor electrical cable through the flex joint.

FIG. 4 is an end view of any of the flex joints showing the shape of the outer surface of the rubber molded around the joints.

Figure 1A:
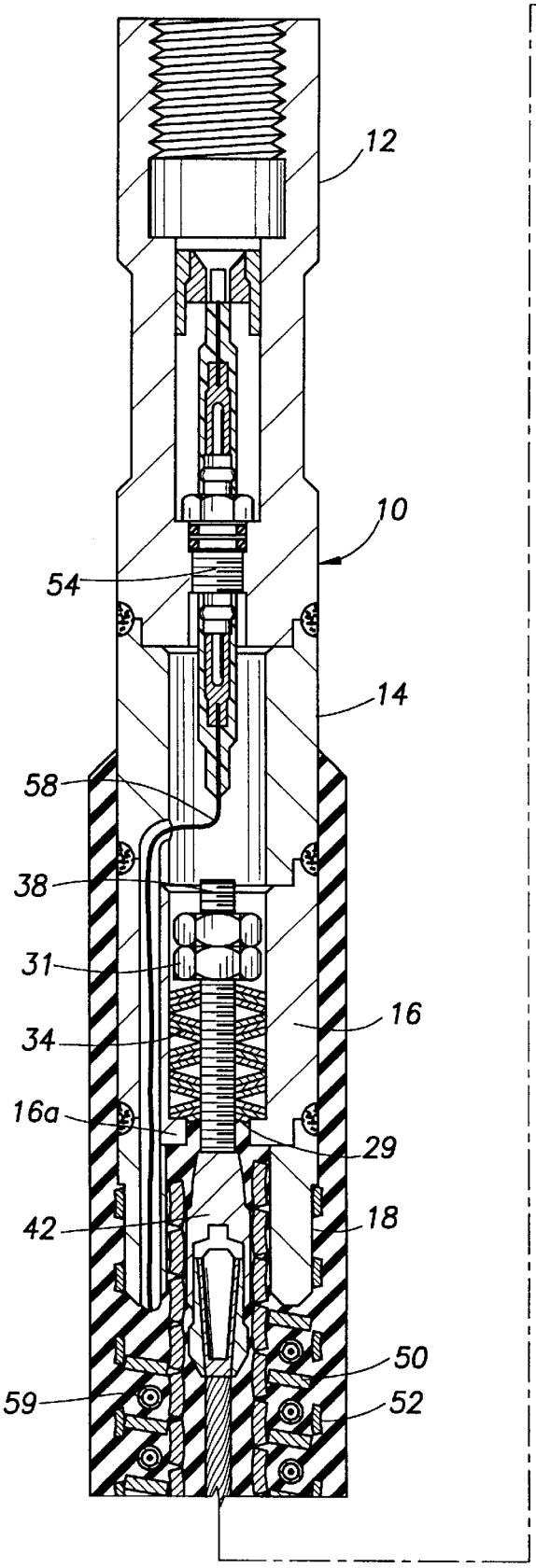
Figure 1B:
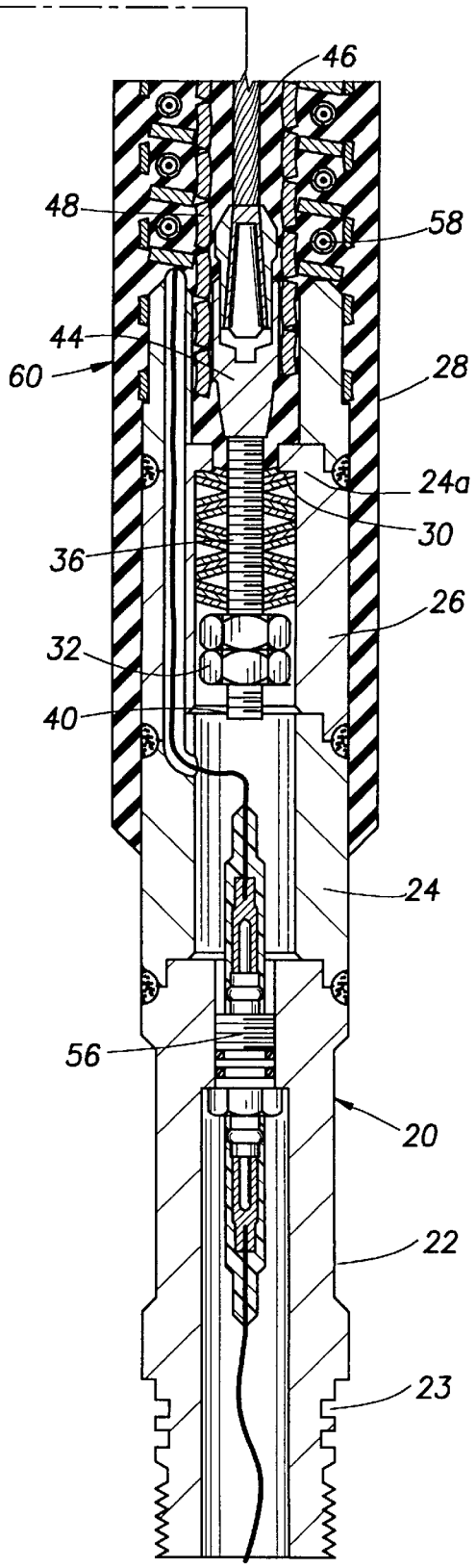

The flex joint as shown in FIG. 1, includes upper connector 10 having threaded box section 12 at its upper end for connecting the flex joint into a downhole assembly. Upper connector 10 also includes axially aligned cylindrical housing sections 14, 16, and 18 all welded together and to box section 12. Lower connector 20 includes cylindrical section 22 and pin 23 for connecting the lower end of the flex joint into a downhole assembly. The lower connector also includes axially aligned cylindrical sections 24, 26, and 28 welded together and to pin section 22.

Cylindrical sections 16 and 26 include inwardly extending flanges 16*a* and 24*a* that engage the end of stacks 29 and 30 of Belleville springs located in cylindrical sections 16 and 26. The other ends of the Belleville washer stacks are engaged by nuts 31 and 32 positioned on threaded shanks 34 and 36 of bolts 38 and 40. The bolts are attached to wire line sockets 42 and 44 that are connected to opposite ends of wire line 46.

Extending between the ends of the upper and lower housings are three helical springs. Innermost: spring 48 is a flat wound helical spring of rectangular wire. The spring extends from between upper housing section 18 and wire line socket 42 on the upper end and lower housing section 28 and wire line socket 44 on the lower end. Surrounding spring 48 is helical spring 50 that is made of rectangular wire wound edgewise. Encircling spring 50 is flat wound helical spring 52 of rectangular wire. Completing the assembly are electrical connectors 54 and 56 that connect with electrical connectors in adjacent housings when the flex joint coupling is connected between two instrument housings of a downhole assembly thereby allowing electrical current to flow through electrical conductor 58 from one housing to the other. Electrical conductor 58 extends between the electrical connectors through tubing 59 that coils around inner spring 48 between the coils of middle spring 50. The coiled tubing protects the electrical conductor without interfering with the bending of the springs as required for the joint to travel through a curved section of a well bore.

Rubber sheath 60 is molded around the spring section and portions of the upper and lower housings.

In operation, nuts 31 and 32 can be adjusted to compress the Belleville washer to place wire rope or cable 46 in tension and the three springs in compression so the springs will tend to urge connectors 10 and 20 into axial alignment. As the assembly travels through a curved well bore, however, it will bend as required to allow the spaced relatively rigid instrument housings of the downhole assembly to which it is connected to pass through a curved well bore.

Figure 2A:
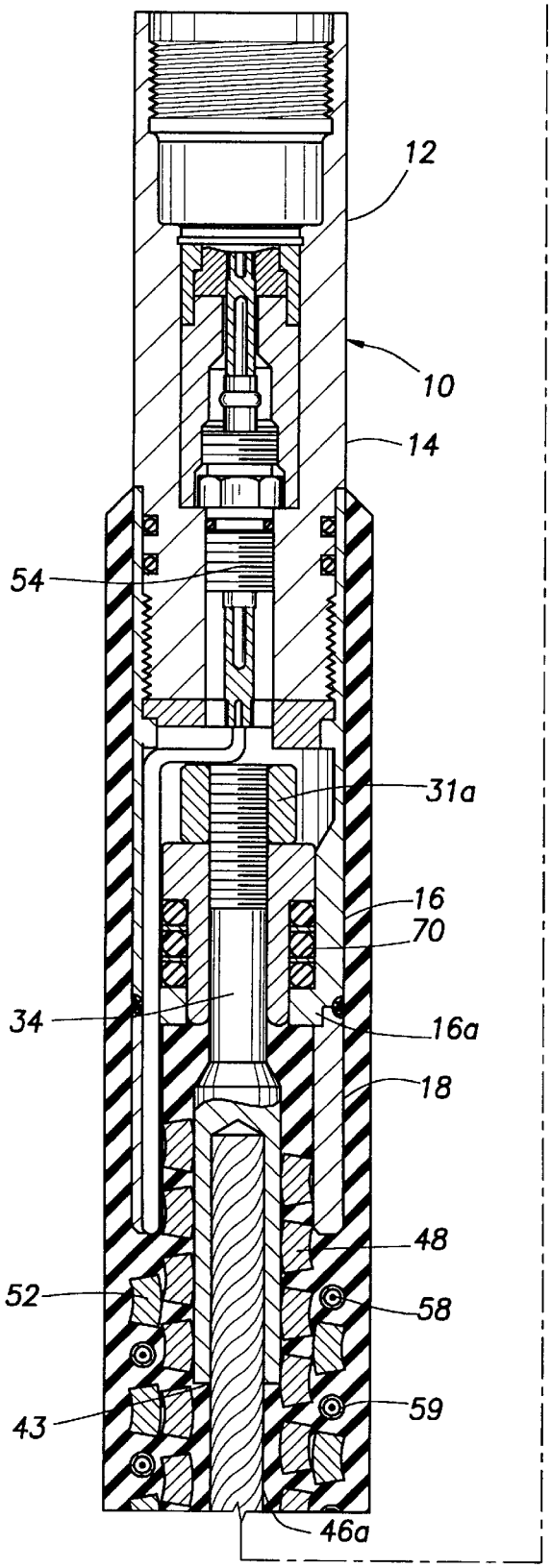
FIG. 2 is a sectional view of another embodiment of the flex joint of this invention that uses different means for anchoring the cable to the connections, two helical springs to resist bending, and an electrical conductor between the housings.
Figure 2B:
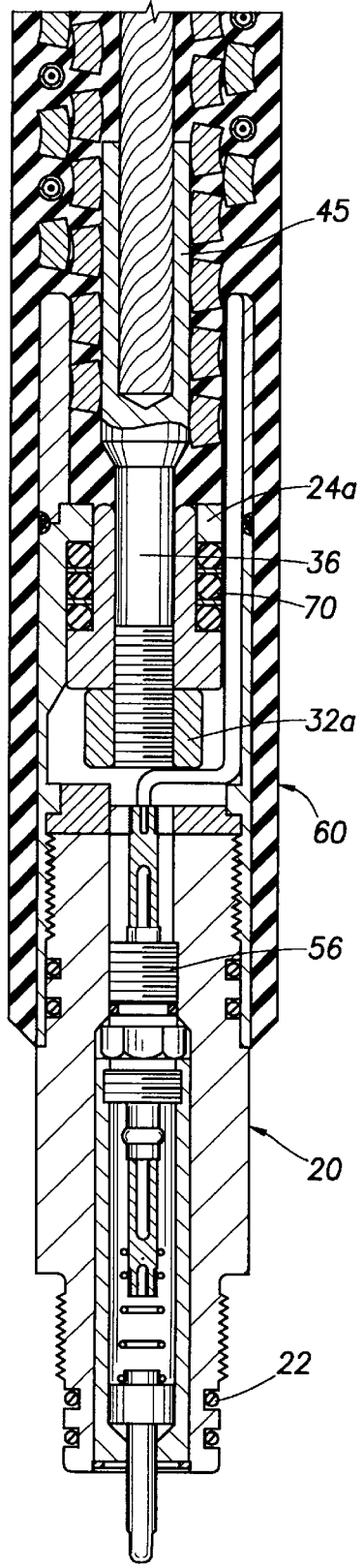

Alternative embodiments of this invention are shown in FIGS. 2 and 3. In FIG. 2, crimping means are used to secure the ends of wire line 46*a* to end connectors 10 and 20. The wire line is inserted into cylindrical sockets 43 and 45 and the sockets are crimped or swaged into engagement with the wire rope with sufficient normal force that the wire rope is held in the sockets by friction against longitudinal forces tending to pull the wire line out of the sockets. Testing performed on this crimping method have shown that it will withstand a longitudinal force of up to 14,000 pounds.

In conjunction with this crimped connection, the embodiment in FIG. 2 uses three o-ring seals 70 in place of the Belleville washers of FIG. 1. The O-rings are located between inwardly extending flanges 16*a* and 24*a*. The seals are compressed by nuts 31*a* and 32*a* on threaded rods 34 and 36 attached to sockets 43 and 45 and exert a resilient force on wire line 46.

Lastly, FIG. 2 uses two rather than three helical springs. Both of these springs are made of rectangular wire that is flat wound around the wire rope. The wire of inner helical spring 48 is coiled so that the spaces between its rings are narrow relative to the spaces between the coils of outer helical spring 52. The outer spring is wrapped around the inner spring such that its rings frequently overlay the spaces between the rings of inner spring 48. The springs resist bending and thus will hold the upper and lower connectors in axial alignment until forced to bend to allow the tool to pass through a curved section of the well bore.

The structure shown in FIG. 3 is similar to that disclosed in FIG. 2 with the exception that wire line 70 is made up of a plurality of strands of wire twisted about 360° from one end to the other. Extending through the strands are a plurality of electrical conductors 72. The ends of the strands of wire are inserted into individual armor sleeves 76 and 78, which are clamped to each group of strands and inserted in sockets 78 and 80. Slotted swage collars 82 and 84 are driven into the sockets to anchor the armor sleeves into the sockets. The electrical conductors extend through the center of the sockets and are connected to multiple pin connectors 82 and 84 mounted in end connectors 85 and 86. O-rings 86 and 88 provide a cushion between sockets 78 and 80 and the connectors at each end of the flex joint.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A flex joint for connecting upper and lower elongated stiff instrument housings of a downhole assembly to allow the elongated stiff instrument housings to move through a curved section of a borehole, said flex joint comprising two connectors, one for connecting to one of the stiff instrument housings and the other to connect to the other stiff instrument housing, a flexible electrical cable adapted to extend between the upper and lower instrument housings to transmit electrical signals between the instrument housings, first, second, and third concentric helical springs adapted to extend between the upper and lower instrument housings and a flexible cable extending between and connected to the two connectors to support the weight of the lower instrument housing of the downhole assembly and to bend as required for the instrument housings to pass through the curved section of the borehole.

2. The flex joint of claim 1, wherein the first, second, and third helical springs are in compression.

3. The flex joint of claim 2, wherein the first and third helical springs are made of rectangular wire coiled lengthwise and the second helical spring is made of rectangular wire coiled flatwise.

4. An instrument assembly for lowering into a well bore having a curved section of relatively short radius, comprising two longitudinally spaced cylindrical instrument housings and a flex joint connected between the cylindrical instrument housings, said joint including spaced tubular connectors for connecting the flex joint between the spaced cylindrical instrument housings, and first and second concentric helical springs extending between and connected to the connectors that will bend as required for the cylindrical housings to travel through the short radius curved section of the well bore, and a flexible cable holding the spring in compression to urge the connectors toward an in-line position, while allowing the flex joint to bend as required to travel the curved section of the well bore.

5. The instrument assembly of claim 4, wherein the assembly further provided with a third helical spring extending between the connectors and concentric with the first and second helical springs.

* * * * *